US005152336A

United States Patent [19]

Wollaber et al.

[11] Patent Number: 5,152,336

[45] Date of Patent: Oct. 6, 1992

[54] AIR CONDITIONER MODULAR UNIT WITH DUAL CROSS FLOW BLOWERS

[75] Inventors: Bruce A. Wollaber, Nolensville; Richard DeVos, Murfreesboro, both of Tenn.

[73] Assignee: Inter-City Products Corporation, LaVergne, Tenn.

[21] Appl. No.: 654,305

[22] Filed: Feb. 12, 1991

Related U.S. Application Data

[63] Continuation-in-part of Ser. No. 478,342, Feb. 12, 1990, abandoned.

[51] Int. Cl.[5] ..... F28D 1/06

[52] U.S. Cl. ..... 165/75; 62/262; 165/122; 417/360

[58] Field of Search ..... 165/75, 122; 417/360; 62/265, 262

[56] References Cited

U.S. PATENT DOCUMENTS

| | | | |
|---|---|---|---|
| 3,200,609 | 8/1965 | Laing | 62/280 |
| 3,301,003 | 1/1967 | Laing | 62/324 |
| 3,404,539 | 10/1968 | Laing | 62/262 |
| 4,100,764 | 7/1978 | Murano | 62/289 |
| 4,111,000 | 9/1978 | Sakazume et al. | 62/262 |
| 4,733,592 | 3/1988 | Blair | 62/263 |
| 4,907,419 | 3/1990 | Kruck et al. | 62/450 |
| 4,951,737 | 8/1990 | Tenhundfeld et al. | 165/57 |

FOREIGN PATENT DOCUMENTS 60-62530 4/1985 Japan .

OTHER PUBLICATIONS

Investigation of the Flow Characteristics in the Impeller of the Tangential Fan.

Fan Design & Applications, The Effect of Rotor and Casing Design on Cross-Flow Fan Performance—D. J. Allen.

Bulletin of the JSME, vol. 19, No. 129, Mar. 1976—An Experimental Study of Cross Flow Fan.

*Primary Examiner*—William E. Wayner

*Attorney, Agent, or Firm*—Baker & Daniels

[57] ABSTRACT

The present invention is an air conditioner with tangential blowers having a removable air handling module. The air conditioner housing includes indoor and outdoor heat exchangers between which the air handling module is disposed. The module is easily inserted or removed from the air conditioner housing because the module is self contained and the air conditioner housing has ample access space. The module includes two tangential blowers disposed between opposite sidewalls which are arranged to draw air through the indoor and outdoor heat exchangers. On one sidewall, a motor is mounted which is drivingly connected to the tangential blowers. The other sidewall includes an opening covered by a removable panel which provides access to the blowers in the interior of the module.

21 Claims, 4 Drawing Sheets

AIR CONDITIONER MODULAR UNIT WITH DUAL CROSS FLOW BLOWERS

RELATED APPLICATIONS

This application is a continuation-in-part of Ser. No. 07/478,342, entitled "AIR CONDITIONER WITH DUAL CROSS FLOW BLOWERS", filed Feb. 12, 1990, now abandoned.

BACKGROUND OF THE INVENTION

1. Field of the Invention

The present invention relates to air conditioners with cross flow blowers. More specifically, the field of the invention is that of modular air handling units for air conditioners.

2. Prior Art

Conventional packaged air conditioners and heat pumps generally include both a conventional centrifugal blower for the indoor heat exchanger and an axial blower for the outdoor heat exchanger. All conventional packaged terminal air conditioners also include some type of dividing wall which divides the indoor portion of the unit from the outdoor portion of the unit. Air is conventionally drawn into the unit through the sides, the rear, the outside, or the bottom of the unit and is blown out of the unit after passing over the heat exchangers.

Air conditioners which have tangential fans for moving air are much more quiet than conventional units because of the lower air velocity through the blowers and optimum spacing between the blower and the cutoff of the air conditioner. Furthermore, the induced air flow through the heat exchanger coils is much more uniform than in conventional units thereby causing substantially full utilization of the indoor and outdoor heat exchanger coils and providing greater efficiency of the appliance.

Further details of a packaged terminal air conditioner are disclosed in copending U.S. patent applications entitled AIR INTAKE ARRANGEMENT FOR AIR CONDITIONER WITH DUAL CROSS FLOW BLOWERS, Ser. No. 478,416, now U.S. Pat. 5,038,577 DRIVING SYSTEM FOR DUAL TANGENTIAL BLOWERS IN AN AIR CONDITIONER, Ser. No. 478,410, now U.S. Pat. No. 5,094,089 both filed on Feb. 12, 1990, and METHOD AND APPARATUS FOR COOLING MOTORS OF CROSS FLOW BLOWERS, filed on Aug. 2, 1990, all assigned to the assignee of the present invention, which disclosures are incorporated herein by reference.

However, one problem with using tangential cross flow blowers involves accessing the air handling section of the air conditioner for repair and servicing. As a result of the separation of the indoor and outdoor sections, the indoor and outdoor blowers are separate and must be individually serviced. Further, the refrigerant coils often block direct access to the blower or its motor, requiring a great deal of time and care to disconnect, move, or otherwise avoid damaging the refrigerant coils.

What is needed is a packaged air conditioner which is easier to service.

Also needed is a package air conditioner providing access to blowers which are not blocked by refrigerant coils.

SUMMARY OF THE INVENTION

The present invention is an air conditioner with dual tangential blowers having a removable air handling module. With the air conditioner of the present invention, the module with the dual tangential blowers can be easily removed from the air conditioner housing for repair or replacement.

The air conditioner of the present invention is easier to service because the modular air handler is removably disposed in the housing. The motor which drives the tangential blowers is mounted on a sidewall of the air handler so that it only needs to be electrically connected to render the module fully operative. The tangential blowers are disposed horizontally and are separated by a dividing wall which includes curved scroll portions which guide air into and out of the tangential blowers. Also, the tangential blowers have axes which are disposed in the same general vertical plane so that the width of the air handler as well as that of the air conditioner are minimized.

Opposite the sidewall on which the motor is mounted, that other sidewall includes an opening covered by a removable panel. When uncovered, the opening allows access to the interior of the air handler as well as allowing removal of either tangential blower. The access panel rotatably supports the tangential blowers when covering the opening, and includes insulation at its abutting surfaces to seal that portion of the sidewall.

The present invention, in one form, is an air conditioner comprising a housing and a modular air handler. The housing includes two spaced-apart heat exchangers. The modular air handler circulates air through the heat exchangers and is disposed in the housing between the heat exchangers. The modular air handler also includes two tangential blowers which are located adjacent to the heat exchangers.

One object of the present invention is to provide a packaged air conditioner which is easier to service.

Another object is to provide a packaged air conditioner having access to blowers which is not blocked by refrigerant coils.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplification set out herein illustrates one preferred embodiment of the invention, in one form, and such exemplifications are not to be construed as limiting the scope of the invention in any manner.

DESCRIPTION OF THE PREFERRED EMBODIMENT

Figure 1:
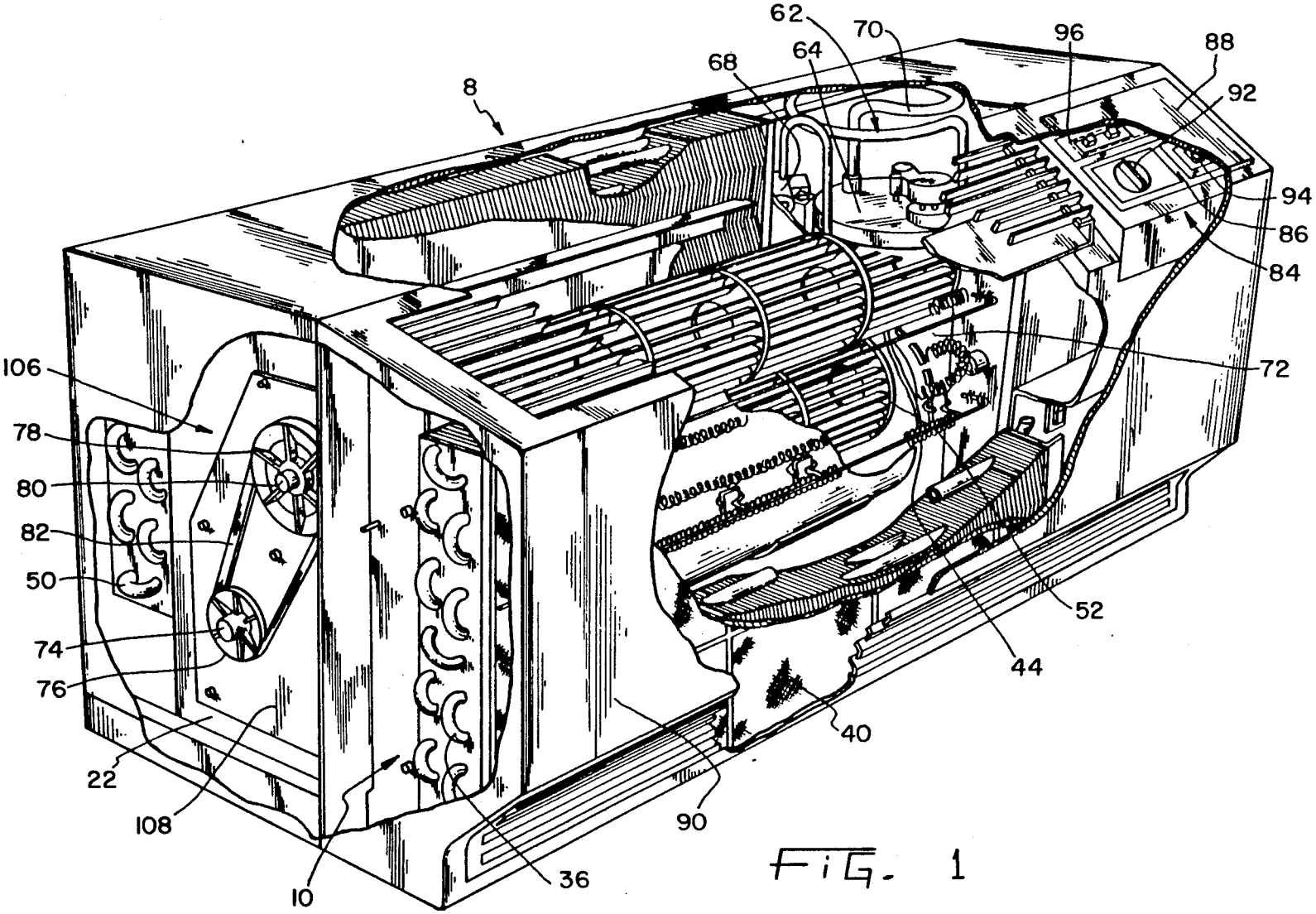
FIG. 1 is a perspective view of the air conditioner of the present invention.
Figure 2:
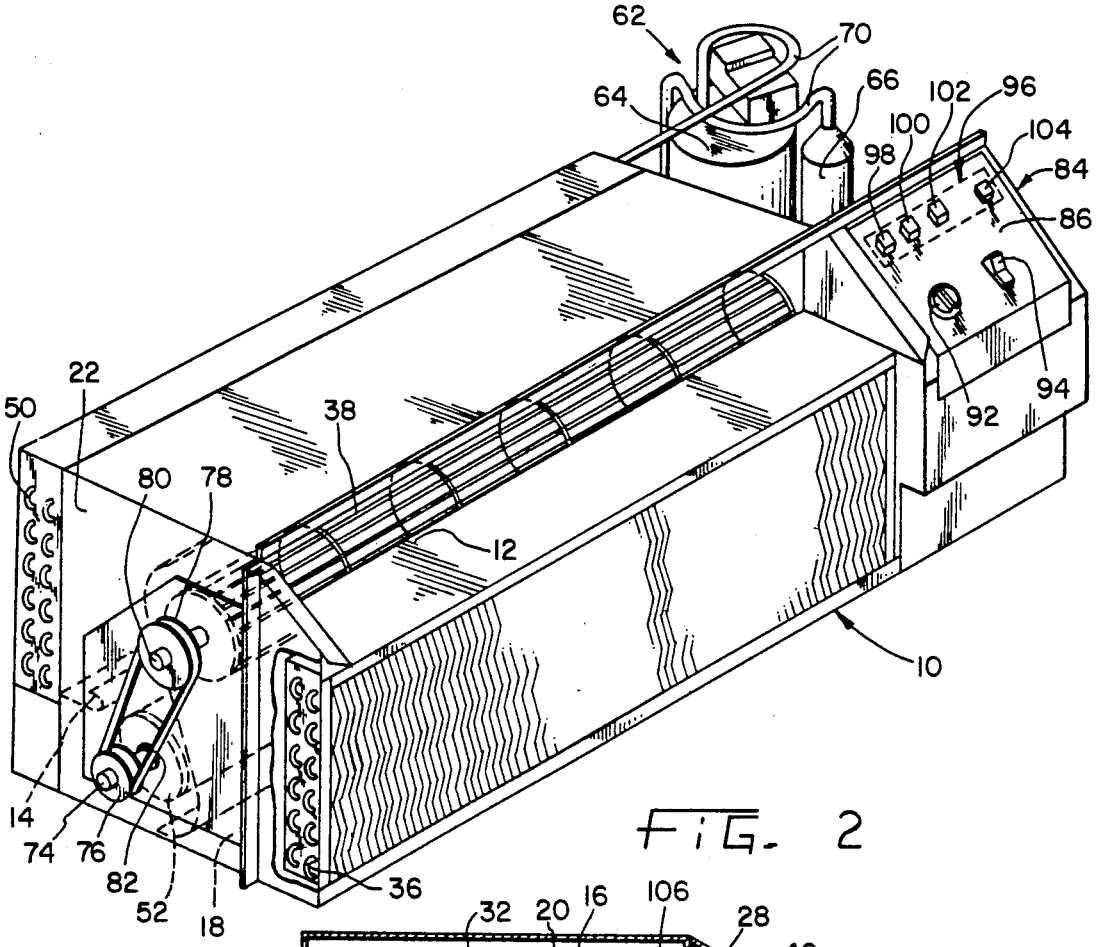
FIG. 2 is a perspective view of the air conditioner without the cabinet.
Figure 3:
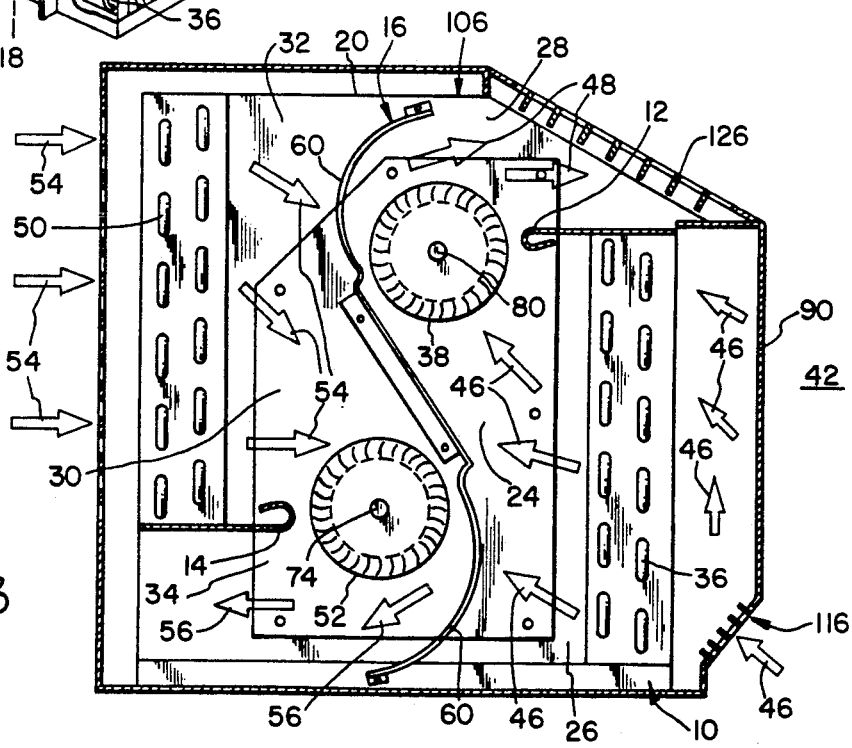
FIG. 3 is a sectional, schematic view of the air conditioner.

The present invention is packaged terminal air conditioner 8 shown in FIGS. 1-3. Air conditioner 8 includes housing 10, indoor cut-off 12, outdoor cut-off 14, divider wall 16, and basepan 18. Housing 10 includes a top wall 20 and side walls 22. Indoor cut-off 12 partitions the front or indoor compartment 24 into an indoor inlet section 26 and an indoor outlet section 28. Outdoor cut-off 14 partitions the rear or outdoor compartment 30 into an outdoor inlet section 32 and an outdoor outlet section 34. Divider wall 16 separates indoor compartment 24 and outdoor compartment 30, with insulation 122 disposed on the outdoor side of wall 16 and foam gasket 124 disposed at the bottom of wall 16 to isolate compartments 24 and 30. To provide a vent or fan only mode, divider wall 16 also includes vent door 128 (see FIG. 6) which may be selectively opened and closed by a suitable mechanism (not shown).

Indoor compartment 24 has a heat exchange coil 36 located within inlet 26, and has a tangential or cross flow blower 38 located upwardly therefrom between indoor cut-off 12 and divider wall 16 near outlet 28. Filter 40 is placed in front of indoor heat exchanger 36 for filtering the recirculated air. Electric heating wires 44 extend within indoor compartment 24 between side walls 22 intermediate indoor heat exchanger 36 and blower 38; heating wires 44 provide additional heat when the heat pump alone cannot provide enough heat. Blower 38 induces a lower air flow (see arrows 46 in FIG. 3) which passes over heat exchanger 36, heating wires 44, and is then exhausted upwardly through discharge grille 126 disposed in outlet 28 (see arrows 48 in FIG. 3).

Outdoor compartment 30 also has a heat exchange coil 50 located within inlet 32, and has tangential or cross flow blower 52 located downwardly between outdoor cut-off 14 and divider wall 16 near outlet 34. Blower 52 induces an upper air flow (see arrows 54 in FIG. 3) which passes over heat exchanger 50 and is then downwardly exhausted through outlet 34 (see arrows 56 in FIG. 3). Outdoor cut-off 14 can be positioned to capture condensate and route the condensate to a pump, draining valve, or other means of condensate disposal.

The refrigeration components 62 are positioned on one side of housing 10. Compressor 64, accumulator 66, valve 68, and refrigerant lines 70 of components 62 operate in a known manner to appropriately heat or cool heat exchanger 36 for conditioning indoor air 42. Electric motor 72 is also located in the same general area of components 62, and drives both indoor blower 38 and outdoor blower 52.

Motor 72 is connected to axis or shaft 74 of driving blower 52, preferably by a resilient hub (not shown). On the opposite side, pulleys 76 and 78 are connected to axes 74 and 80 of driving and driven blowers 52 and 38, respectively. Belt 82 couples pulleys 76 and 78 so that the rotational movement imparted to driving blower 52 is transmitted to driven blower 38. Preferably, driving pulley 76 has a smaller circumference than driven pulley 78 to provide a slower and more comfortable exhaust air flow for the indoor occupants.

Components 62 and motor 72 are electrically coupled to control unit 84. Control unit 84 is located on the same side of air conditioning housing 10 as components 62 and has a control panel 86 facing upwardly under control cover 88. Control cover 88, as well as the other parts of the top surface of indoor panel 90, has a sloping, curved upper surface which helps to prevent damage from the occupants placing heavy objects upon it. In one embodiment, control panel 86 has a rotary switch 92 for variably selecting the temperature intensity, a fan speed switch 94 for selecting between two different fan speeds, and four mutually exclusive mode setting switches 96: cooling mode 98, heating mode 100, fan only mode 102 and off 104. Also included within unit 84, although not shown, is a temperature limiting device which can be set by the owner to prevent the air conditioner from operating outside a predetermined range of temperature settings.

Figure 4:
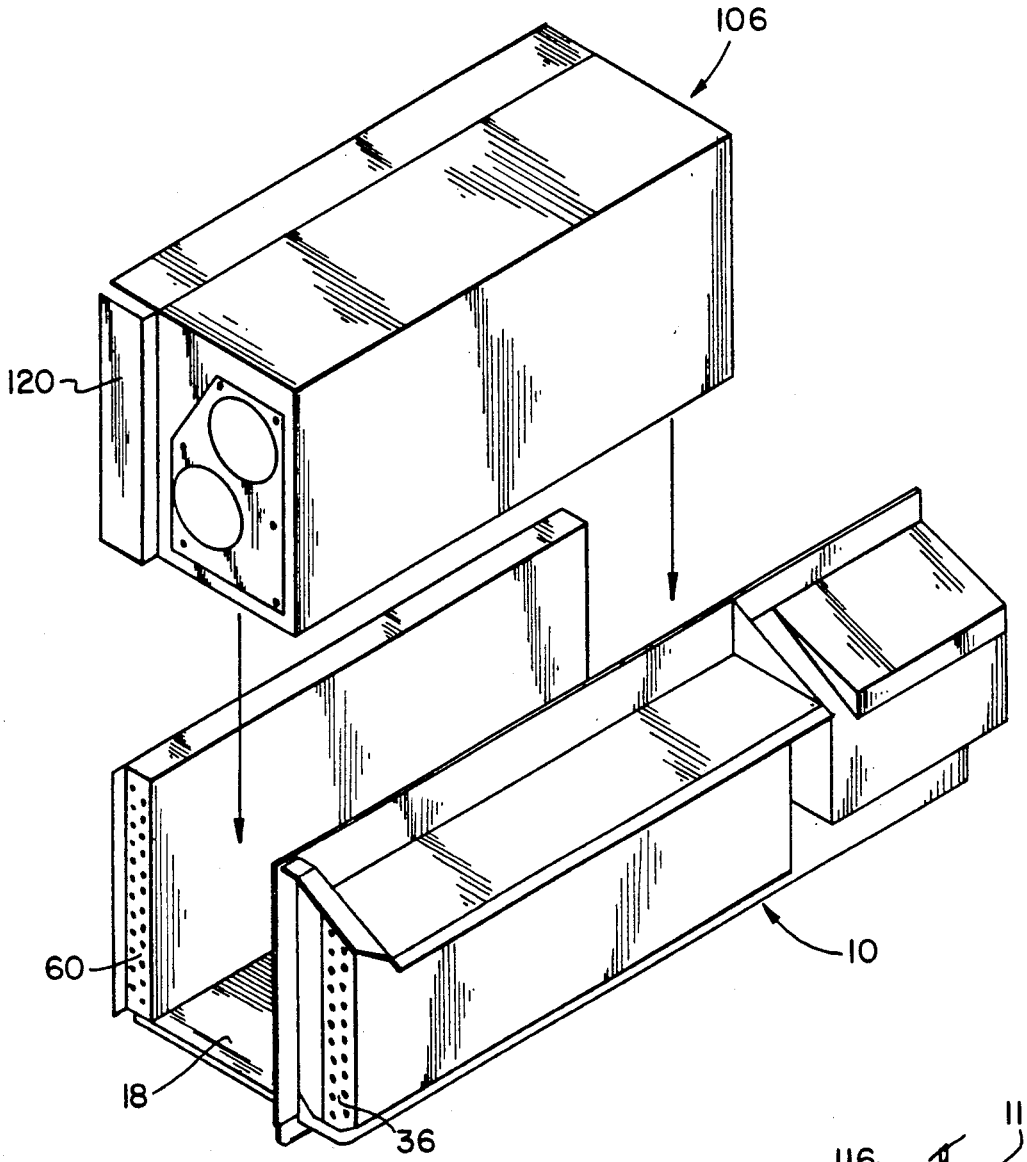
FIG. 4 is an exploded view of the air conditioner of FIG. 2.
Figure 5:
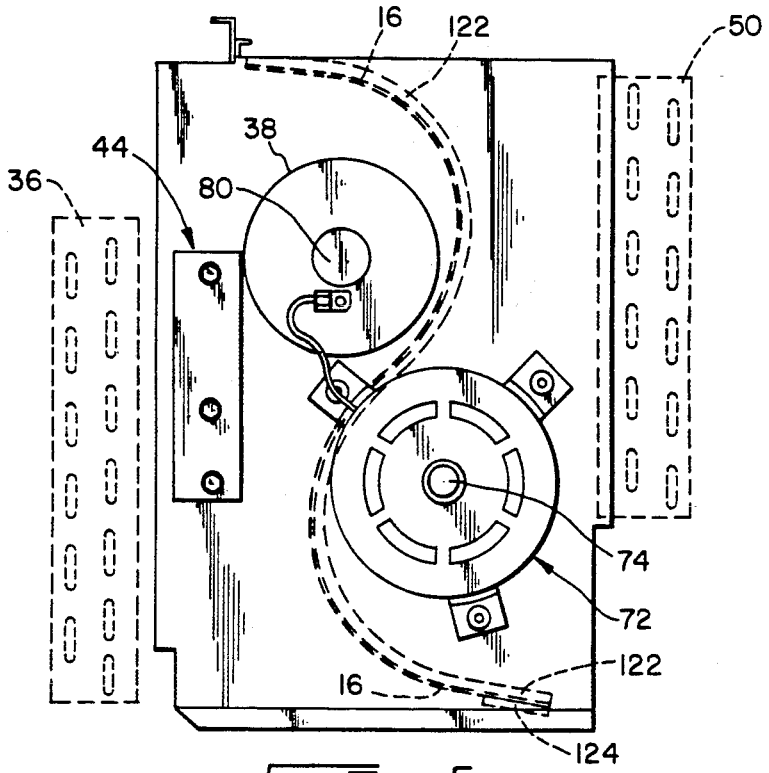
FIG. 5 is side view of the air handling module on the motor side.
Figure 6:
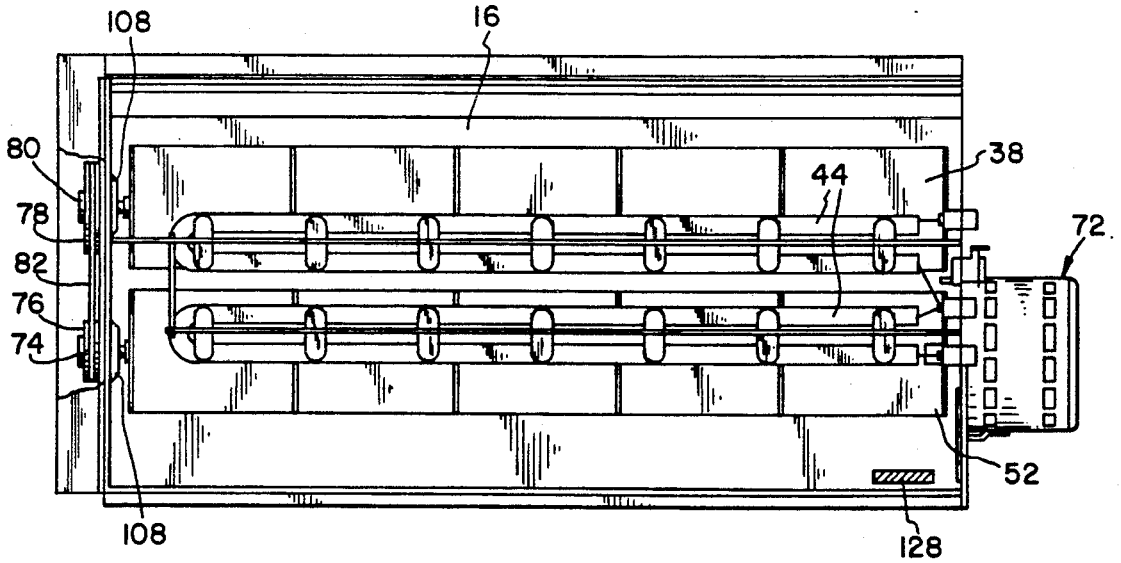
FIG. 6 is a front view of the air handling module of FIG. 5.

In accordance with the present invention as depicted in FIGS. 4-6, air handling module 106 is removably positioned onto the basepan assembly to form air conditioner 8. Preferably, screws or other attaching methods are used to attach module 106 to the basepan assembly.

Indoor compartment 24 and outdoor compartment 30 are at least partially defined by module 106. Divider wall 16 is disposed within module 106, and the lateral sides of module 106 at least partially define sidewalls 22. Blowers 38 and 52 each have one end rotatably mounted in module 106, with electric motor 72 attached to one of sidewalls 22. The other sidewall 22 includes access panel 108 which rotatably supports the other ends of blowers 38 and 52 including pulleys 76 and 78. Facing outdoor heat exchanger 50, module 106 includes a coil protection portion 120 which extends over the top and sides of heat exchanger 50 and provides additional protection from incidental damage.

Divider wall 16 includes curved scroll portions 60 which forms the shape of an "S" to guide air into the tangential blowers. Divider wall 16 is a unitary panel which serves as a scroll for both blowers 38 and 52, and additionally partitions module 106 into indoor and outdoor halves. Portions 60 have an arcuate surface generally corresponding to the shape of blowers 38 and 52, and are connected by a flat portion generally tangential to portions 60.

Also disposed within module 106 are electric heating wires 44. The only connections between housing 10 and air handling module 106 required to make air conditioner 8 fully operational are the electrical connections to motor 72 and heating wires 44. Suitable electric plugs or other known electrical connectors (not shown) may be used to provide power to motor 72 and heating wires 44.

In ordinary operation, air conditioner 8 is mounted through the wall cabinet with only indoor panel 90 visible from the building interior. To access air handling module 106, air conditioner 8 must be withdrawn from the cabinet The electrical connections and any attachments between module 106 and housing 10 are removed and module 106 may then be lifted directly upwards and removed from between heat exchangers 36 and 50, see FIG. 4. Similarly, to install module 106, insert module 106 between heat exchangers 36 and 50 and make the appropriate attachments and electrical connections.

Figure 7:
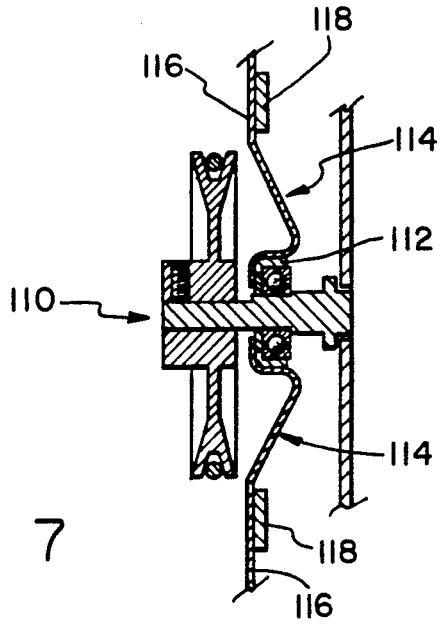
FIG. 7 is a top view, in partial cross-section, of the access plate.

In accordance with the present invention, access panel 108 is removably attached to module 106 to provide easy access to blowers 38 and 52. As shown in FIG. 7, access panel 108 includes rotatable hub 110 with bearing insulator 112. Indented portion 114 supports hub 110 and merges with planar edge surfaces 116 which includes insulation strips 118. When access panel 108 is attached to module 106, strips 118 are trapped between edges 116 and a portion of module 106 defining sidewall 22 to seal the connection and prevent penetration of air or moisture into the interior of module 106. Preferably, access panel 108 is attached to module 106 by a plurality of screws, although other known methods of attachment could be used.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An air conditioner comprising:

a housing including spaced-apart first and second heat exchangers;

a modular air handling means for circulating air through said first and second heat exchangers, said modular air handling means disposed in said housing between said first and second heat exchangers and including first and second tangential blowers located adjacent to said first and second heat exchangers, respectively, and two sidewalls disposed transversely to said first and second heat exchangers with said tangential blowers disposed between said sidewalls, one of said sidewalls including an opening covered by a removable panel, said opening providing access to said tangential blowers and the interior of said housing, said tangential blowers being rotatably mounted in said removable panel.

2. The air conditioner of claim 1 wherein said modular air handling means is removably disposed in said housing.

3. The air conditioner of claim 1 wherein said modular air handling means further includes a motor drivingly connected to said tangential blowers.

4. The air conditioner of claim 1 wherein said modular air handling means includes a dividing wall separating said modular air handling means into first and second compartments.

5. The air conditioner of claim 4 wherein said dividing wall includes first and second curved scroll portions to guide air into said first and second tangential blowers.

6. The air conditioner of claim 1 wherein said tangential blowers are arranged substantially horizontally and face said respective heat exchangers.

7. The air conditioner of claim 1 wherein said modular air handling means includes an electric heater.

8. The air conditioner of claim 1 wherein said tangential blowers have axes which are arranged in a common, generally vertical plane.

9. The air conditioner of claim 1 wherein said modular air handling means includes a motor mounted on one of said sidewalls and drivingly connected to said tangential blowers.

10. The air conditioner of claim 1 wherein said removable panel includes insulation abutting the one of said sidewalls.

11. An air conditioner comprising:

a generally U-shaped basepan including a heat exchanger portion and an auxiliary portion;

a compressor disposed in said auxiliary portion of said basepan;

first and second heat exchangers respectively located on the opposite sides of said basepan;

a space defined by said basepan and said indoor and outdoor heat exchangers, said space having an upwardly facing opening; and a modular air handler removably located in said space, including a dividing wall for dividing said modular air handler into first and second air handling compartments, said modular air handler further including first and second tangential blowers disposed on opposite sides of said dividing wall and adjacent to respective said first and second heat exchangers so that when said modular air handler is disposed within said space said modular air handler is adapted to circulate air through said first and second heat exchangers, said modular air handler having a shape generally matching the shape of said opening of said space whereby said modular air handler may be directly inserted into and removed from said space.

12. The air conditioner of claim 11 wherein said modular air handler further includes a motor drivingly connected to said tangential blowers.

13. The air conditioner of claim 11 wherein said dividing wall includes first and second curved scroll portions to guide air into said first and second tangential blowers.

14. The air conditioners of claim 11 wherein said tangential blowers are arranged substantially horizontally and face said respective heat exchangers.

15. The air conditioner of claim 11 wherein said modular air handler includes an electric heater.

16. The air conditioner of claim 11 wherein said tangential blowers have axes which are arranged in a common, generally vertical plane.

17. The air conditioner of claim 11 wherein said modular air handler includes two sidewalls disposed transversely to said first and second heat exchangers.

18. The air conditioner of claim 17 wherein said tangential blowers are disposed between said sidewalls.

19. The air conditioner of claim 18 wherein one of said sidewalls includes an opening covered by a removable panel, said opening provides access to said tangential blowers and the interior of said housing, and said tangential blowers are rotatably mounted in said removable panel.

20. The air conditioner of claim 19 wherein said modular air handler includes a motor mounted on one of said sidewalls and drivingly connected to said tangential blowers.

21. The air conditioner of claim 19 wherein said removable panel includes insulation abutting the one of said sidewalls.

* * * * *